US010255743B2

(12) United States Patent
Chosson et al.

(10) Patent No.: US 10,255,743 B2
(45) Date of Patent: Apr. 9, 2019

(54) SECURITY DEVICE FOR SECURITY DOCUMENT

(71) Applicant: ORELL FÜSSLI SICHERHEITSDRUCK AG, Zürich (CH)

(72) Inventors: Sylvain Chosson, Zürich (CH); Dieter Sauter, Dietikon (CH)

(73) Assignee: ORELL FUSSLI SICHERHEITSDRUCK AG, Zurich (CH)

( * ) Notice: Subject to any disclaimer, the term of this patent is extended or adjusted under 35 U.S.C. 154(b) by 210 days.

(21) Appl. No.: 15/107,646

(22) PCT Filed: Dec. 22, 2014

(86) PCT No.: PCT/CH2014/000178
§ 371 (c)(1),
(2) Date: Jun. 23, 2016

(87) PCT Pub. No.: WO2015/095977
PCT Pub. Date: Jul. 2, 2015

(65) Prior Publication Data

US 2016/0321852 A1 Nov. 3, 2016

(30) Foreign Application Priority Data

Dec. 23, 2013 (WO) ..... PCT/CH2013/000230

(51) Int. Cl.
*G07D 7/128* (2016.01)
*B42D 25/351* (2014.01)
(Continued)

(52) U.S. Cl.
CPC ..... *G07D 7/128* (2013.01); *B42D 25/24* (2014.10); *B42D 25/29* (2014.10); *B42D 25/351* (2014.10);
(Continued)

(58) Field of Classification Search
CPC ..... B42D 2035/36; B42D 2035/50; B42D 25/24; B42D 25/29; B42D 25/351; G07D 7/128; H04N 1/4078
See application file for complete search history.

(56) References Cited

U.S. PATENT DOCUMENTS 5,449,200 A 9/1995 Andric et al.
6,036,233 A 3/2000 Braun et al.
(Continued)

FOREIGN PATENT DOCUMENTS

DE 195 41 064 A1 5/1997
DE 102 60 124 A1 7/2004
(Continued)

OTHER PUBLICATIONS

Rudolf L. van Renesse, Optical Document Security, Third Edition, 2005, pp. 133-135.
(Continued)

*Primary Examiner* — David R Dunn
*Assistant Examiner* — Christopher E Veraa
(74) *Attorney, Agent, or Firm* — Ladas & Parry LLP

(57) ABSTRACT

A security device for verifying an authenticity of a security document comprises an at least partially transparent substrate with a first surface and a second surface. A first pattern is arranged on the first surface. A second pattern is arranged on said second surface. The first and the second pattern each comprise a plurality of pixels with at least three different gray levels visible from a macroscopic perspective. The first and second pattern cover only gray levels in a range between 20% black and 80% black, in particular between 35% black and 65% black. The first pattern is inverted with respect to the second pattern.

15 Claims, 7 Drawing Sheets

(51) Int. Cl.
*B42D 25/24* (2014.01)
*B42D 25/29* (2014.01)

(52) U.S. Cl.
CPC ..... *B42D 2035/36* (2013.01); *B42D 2035/50* (2013.01)

(56) References Cited

U.S. PATENT DOCUMENTS

| | | | | |
|---|---|---|---|---|
| 6,089,614 | A | 7/2000 | Howland et al. | |
| 6,827,283 | B2 | 12/2004 | Kappe et al. | |
| 7,997,625 | B2 * | 8/2011 | Dean | B41M 3/148 283/114 |
| 2006/0197990 | A1 | 9/2006 | Myodo et al. | |
| 2009/0059254 | A1 * | 3/2009 | Kobayashi | G06T 1/0028 358/1.9 |
| 2010/0164219 | A1 | 7/2010 | Jeacock et al. | |
| 2012/0182443 | A1 | 7/2012 | Vincent | |
| 2013/0181435 | A1 | 7/2013 | Hersch et al. | |
| 2015/0244727 | A1 | 8/2015 | Fournel et al. | |

FOREIGN PATENT DOCUMENTS

| | | | |
|---|---|---|---|
| EP | 0 310 707 | A2 | 4/1989 |
| EP | 0 628 408 | A1 | 12/1994 |
| EP | 1 580 025 | A2 | 9/2005 |
| EP | 2 522 529 | A2 | 11/2012 |
| WO | 97/47478 | A1 | 12/1997 |
| WO | 1997/47487 | | 12/1997 |
| WO | 98/15418 | A1 | 4/1998 |
| WO | 02/27647 | A1 | 4/2002 |
| WO | 2009/010714 | A1 | 1/2009 |
| WO | 2009/056351 | A1 | 5/2009 |
| WO | 2009/056355 | A1 | 5/2009 |
| WO | 2011/007343 | A1 | 1/2011 |
| WO | 2014/041298 | A2 | 3/2014 |

OTHER PUBLICATIONS

International Search Report dated Jan. 31, 2013 for International Application No. PCT/CH2012/000073.
International Search Report and Written Opinion of the International Searching Authority dated Sep. 19, 2014 for International Application No. PCT/CH2013/000230.
International Search Report dated Sep. 19, 2014 for International Application No. PCT/CH2013/000231.
International Preliminary Report on Patentability dated Oct. 1, 2014 for International Application No. PCT/CH2012/000073.
International Search Report and Written Opinion of the International Searching Authority dated Feb. 2, 2015 for International Application No. PCT/CH2014/000078.
International Search Report and Written Opinion of the International Searching Authority dated Mar. 16, 2015 for International Application No. PCT/CH2014/000053.
International Search Report and Written Opinion of the International Searching Authority dated Mar. 16, 2015 for International Application No. PCT/CH2014/000179.
International Preliminary Report on Patentability dated Jun. 28, 2016 for International Application No. PCT/CH2013/000231.
English translation of DE 102 60 124 A1.
Espacenet English abstract of WO 2009/056351 A1.
English translation of WO 2009/056351 A1.
Espacenet English abstract of EP 2 522 529 A2.
English translation of EP 2 522 529 A2.
Espacenet English abstract of WO 2009/056355 A1.
English translation of WO 2009/056355 A1.
English translation of EP 1 580 025 A2.
Chosson, S., et al., "See-through images", Optical Documents Security, 2014, pp. 1-8.
Machizaud, J., et al., "Spectral transmittance model for stacks of transparencies printed with halftone colors", Color Imaging XII: Processing, Hardcopy and Applications, 2012, 10 pages.
Machizaud, J., et al., "Spectral reflectance and transmittance prediction model for stacked transparency and paper both printed with halftone colors", Optical Society of America, vol. 29, No. 8, Aug. 2012, pp. 1537-1548.
English Abstract of WO 1997/47487.
English Abstract of EP 1580 025 A2.

* cited by examiner

SECURITY DEVICE FOR SECURITY DOCUMENT

CROSS-REFERENCE TO RELATED APPLICATION

This U.S. application claims priority under 35 U.S.C. 371 to, and is a U.S. National Phase application of, the International Patent Application No PCT/CH2014/000178, filed 22 Dec. 2014 which claims priority from CH PCT/CH2013/000230 filed 23 Dec. 2013, the entire content of the above-mentioned patent application is incorporated by reference as part of the disclosure of this U.S. application.

TECHNICAL FIELD

The invention relates to a security device for verifying an authenticity of a security document as well as to a security document, e.g., a banknote, a passport, a document of value, a certificate, or a credit card which comprises such a security device. Furthermore, the invention relates to a method for verifying the authenticity of such a security document.

BACKGROUND ART

US 2006/0197990 A1 discloses a superposition of two tally images, thus revealing a hidden image. The hidden image cannot be reconstructed from a single tally image.

WO 97/47487 describes a security device having two simple patterns printed on opposite sides of a substrate, which generate different images when seen in reflection and transmission.

EP 1580025 describes a security device which shows, under a certain viewing angle, optically recognizable features.

WO 2009/010714 discloses a security device comprising a substrate having a viewing region and a first pattern of a first colour and a second pattern of a second colour on a first side of the viewing region. On the second side the first and the second pattern are arranged in register with respect to the first side, where the colours are reversed.

DISCLOSURE OF THE INVENTION

It is an object of the present invention to provide a security device for verifying an authenticity of a security document. Another object of the invention is to provide a security document comprising such a security device. Another object of the invention is to provide a method for generating a security device. Yet another object of the invention is to provide a method for verifying the authenticity of such a security document.

These objects are achieved by the devices and the method of the independent claims.

Accordingly, a security device for verifying an authenticity of a security document (such as a banknote, a passport, a document of value, a certificate, or a credit card) comprises an at least partially transparent substrate with a first surface and a second surface.

Herein, the term "at least partially transparent" relates to an optical property of a nonzero transmission of light at at least one wavelength, in particular in the visible regime between 380 nm and 780 nm. Thus, in a transmission viewing mode, a nonzero amount of light can be shone through said substrate. Advantageously, a transmittance of the substrate is higher than 50%, at least for one transmitted wavelength (which is in particular in the visible regime between 380 nm and 780 nm).

Advantageously, the substrate is flat and/or flexible (e.g., its thickness is smaller than 500 μm, in particular smaller than 120 μm) and the second surface can be on the opposite side of a flat substrate than the first surface. This simplifies the application in security documents which are usually flat and/or flexible to some degree.

Furthermore, the security device comprises a first pattern (e.g., a halftone, grayscale, or a color image) which is arranged on said first surface of said substrate. Furthermore, the security device comprises a second pattern (e.g., a halftone, grayscale, or a color image) which is arranged on said second surface of said substrate, e.g., opposite said first surface (see above). Furthermore the first pattern and the second pattern each comprise a plurality of pixels with at least three different gray levels visible from a macroscopic perspective. The term "three different gray levels visible from a macroscopic perspective" relates to the fact that patterns might be printed in halftone, which simulates continuous tone imagery through the use of dots or other symbols, varying either in size, in shape or in spacing, thus generating a gradient like effect. The term "three different gray levels visible from a macroscopic perspective" means that the human eye would see different gray levels, although the dots in microscopic perspective have all the same grey level, in particular black.

The first pattern and the second pattern cover only gray levels in a range between 20% black and 80% black, in particular between 35% black and 65% black, wherein the first pattern is inverted with respect to the second pattern. The restriction to this range yields a perceived black level in transmission viewing mode of the superposed inversed first and second patterns between 75% and 84%, in particular between 75% and 77.25%. This is a range of black levels, in particular a range of black levels of 5%, where the black levels are not or at least hardly distinguishable or discernible by the naked eye of a viewer without visual aids.

The term "inverted" in particular means the generation of the contrary black level in the gray scale space, e.g. a 20% black level is inverted to an 80% black level. In more general terms, a black level of x % is inverted to a black level of (100%-x %).

The first pattern on the first surface arranged fully in register with the second pattern on the second surface.

As an effect, in particular in a range between 35% black and 65% black, a transmission-mode-viewer (e.g., with a naked eye without visual aids) sees a homogeneous image, if the first and the second pattern are superposed, because the first and the second pattern cancel each other out in the transmission viewing mode.

However, in a reflection viewing mode, for at least one reflected wavelength (which is advantageously the same wavelength than the transmitted wavelength discussed above) from said security device, information contained in the first or in the second pattern can be discerned since the first and the second pattern do not cancel each other out.

As an effect, according to the invention, the visual appearance and reconstructable information content of the security device depends on the viewing mode and security is thus enhanced considerably.

Advantageously the average black level of the first and second pattern is 50%+/−5%. Thus the range of perceived black level in transmission viewing mode of the superposed inversed first and second pattern is minimized for the corresponding range of black levels on the first and the second pattern.

Advantageously the first and the second pattern are applied, in particular printed, by absorbing inks. This increases the contrast between the absorbing ink and the substrate in the reflection viewing mode.

Advantageously, the substrate comprises multiple layers with the same or different optical properties (such as transmission spectra). Thus, more specific effects can be realized and security is enhanced.

In particular, the first and/or the second pattern can be covered with one or more additional layer (s), e.g., for reducing specular reflections from the first and/or second substrate surface.

In an advantageous embodiment of the security device, the first pattern is applied, in particular printed (e.g., via offset printing, screen printing, or sublimation printing), onto said first surface of said substrate and/or the second pattern is applied, in particular printed (e.g., via offset printing or screen printing, or sublimation printing), onto said second surface of said substrate. Thus, the security device can be manufactured more easily.

Optionally, a primer layer can be applied below the first and/or second pattern in order to ensure the stability of the printed inks.

In another advantageous embodiment of the security device, a first region of the first pattern has an inverted transmittance and an inverted reflectivity with respect to a third region of said second pattern. Furthermore, in this embodiment, a second region of the first pattern has an inverted transmittance and an inverted reflectivity with respect to a fourth region of said second pattern.

Herein, the terms "inverted transmittance" and "inverted reflectivity" relate to a transmittance/reflectivity value (e.g., of a specific region) which is "inverted" with respect to an ideal 100% transmission/reflection at one or more wavelength(s) (in particular in the visible regime between 380 nm and 780 nm) and with respect to another transmittance/reflectivity value (e.g., that of another region). As examples, for a 90% transmittance of the first region, an inverted transmittance of the third region would be 10%. A 20% reflectivity of the third region is inverted with respect to an 80% reflectivity of the first region.

Thus, it is easier to select the transmittances and reflectivities of the first to fourth regions such that the above-discussed visual appearance effects occur in the transmission and reflection viewing modes.

More advantageously, the whole first and second patterns (i.e., all regions in the respective patterns) have inverted transmittances and reflectivities with respect to each other.

In another advantageous embodiment of the security device, the gray levels of the first pattern (10) and of the second pattern (20) are indiscernible at least when an overall (i.e., spatially integrated over the whole security device) transmitted light intensity through the security device (in the transmission viewing mode) outshines an overall (i.e., spatially integrated over the whole security device) reflected light intensity from the security device at least by a factor of 5. In other words, in this embodiment, a definition for "transmission viewing mode" is that the overall transmitted light intensity through the security device outshines an overall reflected light intensity from the security device at least by the above-mentioned factor.

Thus, it is easier to select the transmittances and reflectivities of the first to fourth regions such that the above-discussed visual appearance effects occur in the transmission viewing mode.

In another advantageous embodiment of the security device, the gray levels of the first pattern (10) and of the second pattern (20) are discernible at least when an overall (i.e., spatially integrated over the whole security device) reflected light intensity from the security device outshines an overall (i.e., spatially integrated over the whole security device) transmitted light intensity through said security device at least by a factor of 5. In other words, in this embodiment, a definition for "reflection viewing mode" is that the overall reflected light intensity from the security device outshines an overall transmitted light intensity through the security device at least by the above-mentioned factor.

Thus, it is easier to select the transmittances and reflectivities of the first to fourth regions such that the above-discussed visual appearance effects occur in the reflection viewing mode.

In another advantageous embodiment, the security device further comprises a third pattern (e.g., a halftone, grayscale, or a color image) with different gray levels arranged on or in said substrate (or, in case of a multilayered substrate, e.g., between different substrate layers). In said transmission viewing mode and in said reflection viewing mode, said different gray levels of said third pattern (30) are discernible.

As an effect, a transmission-mode-viewer as well as a reflection-mode-viewer can reconstruct information contained in the third pattern (i.e., the fifth/sixth regions). This is possible in the transmission as well as in the reflection viewing modes.

In another advantageous embodiment of the security device, the first pattern and/or the second pattern and/or the substrate comprises a color filter. This makes it easier to select one or more transmitted and/or reflected wavelength(s).

As another aspect of the invention, a security document (e.g., a banknote, a passport, a document of value, a certificate, or a credit card) comprises a security device as described above. The security device is advantageously arranged in a window (i.e., a transparent region) of (the substrate of) the security document. As an effect, the visual appearance and reconstructable information content of the security document can be more easily made dependent on the viewing mode. Thus, security is enhanced and counterfeiting is considerably aggravated.

Advantageously, such a security document further comprises a light absorber, in particular arranged at a distance to the security device. Then, for example by folding the security document along an applied, in particular printed, folding line, the light absorber can be brought into overlap with the security device. As an effect, the amount of transmitted light is reduced by the light absorber and thus a reflection viewing mode is reached more easily. As an effect, handling is improved when the authenticity of the security document is to be checked.

Advantageously, the light absorber has a reflectivity of less than 50% at least for said at least one reflected wavelength from said security device and/or the light absorber has a transmittance of less than 50% at least for said at least one transmitted wavelength through said security device. The light absorber can, e.g., comprise a region of the security document which is covered by a dark color, e.g., 100% black. As an effect, the reflection viewing mode of the security device is reached more easily and handling is improved when the authenticity of the security document is to be checked.

As another aspect of the invention, a method for verifying an authenticity of a security document as described comprises steps of providing the security document which comprises a security device as described above, from a first viewing position acquiring a first image of said security device in a transmission viewing mode (e.g., against a ceiling lamp), from a second viewing position (which can be the same or a different position than the first viewing position) acquiring a second image of said security device in a reflection viewing mode. Hereby, the first pattern is oriented towards the second viewing position.

Furthermore, the method comprises a step of deriving said authenticity of said security document using the first (transmission viewing mode) image and using the second (reflection viewing mode) image.

Because of the specific and different visual appearances in transmission viewing mode (first region cannot be discerned from third region and/or second region cannot be discerned from fourth region) and reflection viewing mode (first region can be discerned from third region), the authenticity of the security document is easier to derive.

Advantageously, during the step of acquiring said second image, an overall reflected light intensity from said security device outshines an overall transmitted light intensity through said security device at least by a factor of 5. Thus, the reflection viewing mode is easier to establish.

In another advantageous embodiment, during said step of acquiring said first image, an overall transmitted light intensity through said security device outshines an overall reflected light intensity from said security device at least by a factor of 5. Thus, the transmission viewing mode is easier to establish.

Advantageously, the method comprises a step of bringing a light absorbing device into an overlap with said security device. Thus, an amount of transmitted light through the security device is reduced and the reflection viewing mode is easier to establish. Then, the step of acquiring said second image of said security device is carried out with said light absorbing device being arranged in said overlap with said security device, e.g., opposite said second viewing position. This simplifies the handling of the security document for acquiring the reflection viewing mode image.

Advantageously, from a third viewing position (which is, again, the same or different from the first and/or the second viewing position(s)), a third image of said security device is acquired in a reflection viewing mode, but now with said second pattern being oriented towards said third viewing position. Then, this third image is also used in said step of deriving said authenticity of said security document. Thus, the security can be further enhanced.

As another aspect of the invention, a method for generating a first pattern and a second pattern for use in a security device as described above comprises steps of providing an at least partially transparent substrate (2), in particular with specular reflection in a reflection viewing mode, and with a first surface (3) and a second surface (4), providing a first source image with at least three different gray levels, modifying a contrast of said first source image to generate a first modified image, wherein the first modified image covers only gray levels in a range between 20% black and 80% black, in particular 35% and 65% black. For example the first source image has black level between 0% and 100% black. The brightness and contrast of the first source image are modified to ensure that all black level are between 20% and 80% black, in particular between 35% and 65% black. In other words, its histogram of gray levels is shrunken. It should be noted that modifying the contrast of said first source image is unnecessary, if it already meets the stated range requirements.

Furthermore, the method comprises steps of inverting the first modified image for yielding a second modified image, generating a first pattern from said first modified image, generating a second pattern from said second modified image, applying, in particular printing, the first pattern (10) on said first surface (3) of said substrate (2), applying, in particular printing, the second pattern (20) on said second surface (4) of said substrate (2).

The term "generating" can e.g. mean that the first pattern or second pattern are equal to the first modified pattern or to the second modified pattern respectively or it can e.g. mean that the first pattern or the second pattern are a result of mixing the first pattern with a third pattern and/or a result of mixing the second pattern with a third pattern respectively.

The first pattern on the first surface arranged fully in register with the second pattern on the second surface.

Advantageously, for generating the first and or second pattern, a third pattern is mixed with the first modified image to generate the first pattern and/or wherein the third source image is mixed with the second modified image to generate the second pattern (20) such that in a transmission viewing mode only the third pattern (30) is visible while the first pattern (10) and the second pattern (20) cancel each other out because they are inverted images. The third pattern can be generated by shrinking the histogram of gray levels.

Advantageously the average black level of the first and second pattern is 50%+/−5%. Thus the range of perceived black level in transmission viewing mode of the superposed inversed first and second pattern is minimized for the corresponding range of black levels on the first and the second pattern.

Advantageously the first and the second pattern are applied, in particular printed, by absorbing inks. This increases the contrast between the absorbing ink and the substrate in the reflection viewing mode.

Advantageously the substrate is partially reflecting, in particular specularly reflecting. The term "specularly reflecting" in particular relates to the mirror-like reflection of light from a surface, in which light from a single incoming direction is reflected into a single outgoing direction. The direction of incoming light and the direction of outgoing light reflected make the same angle with respect to the surface e normal.

Remark:

The invention is not limited to halftone or grayscale patterns. Although the description and FIGS. herein mainly focus on halftone and grayscale patterns for the sake of clarity, analogous considerations can be made for each color channel of color patterns which renders the subject-matter of the invention feasible for color patterns.

Hence, terms of the type "gray level", or "black" are understood to express the color density of the patterns. For example the term "gray level of x % black" expresses that the color density is x %.

This definition can be used for any kind of ink or dye, e.g. red, green or blue dyes. However, the invention shows strongest effects at a wavelength where the ink or dye is fully absorbing. In other words, for best results over the whole visible range, the patterns are advantageously printed in black ink or dye, in which case the term "gray level of x % black" expresses a pattern that absorbs x % over the whole visible spectrum.

The described embodiments similarly pertain to the devices and the methods. Synergetic effects may arise from different combinations of the embodiments although they might not be described in detail.

BRIEF DESCRIPTION OF THE DRAWINGS

The invention will be better understood and objects other than those set forth above will become apparent when consideration is given to the following detailed description thereof. Such description makes reference to the annexed drawings, wherein.

MODES FOR CARRYING OUT THE INVENTION

Figure 1:
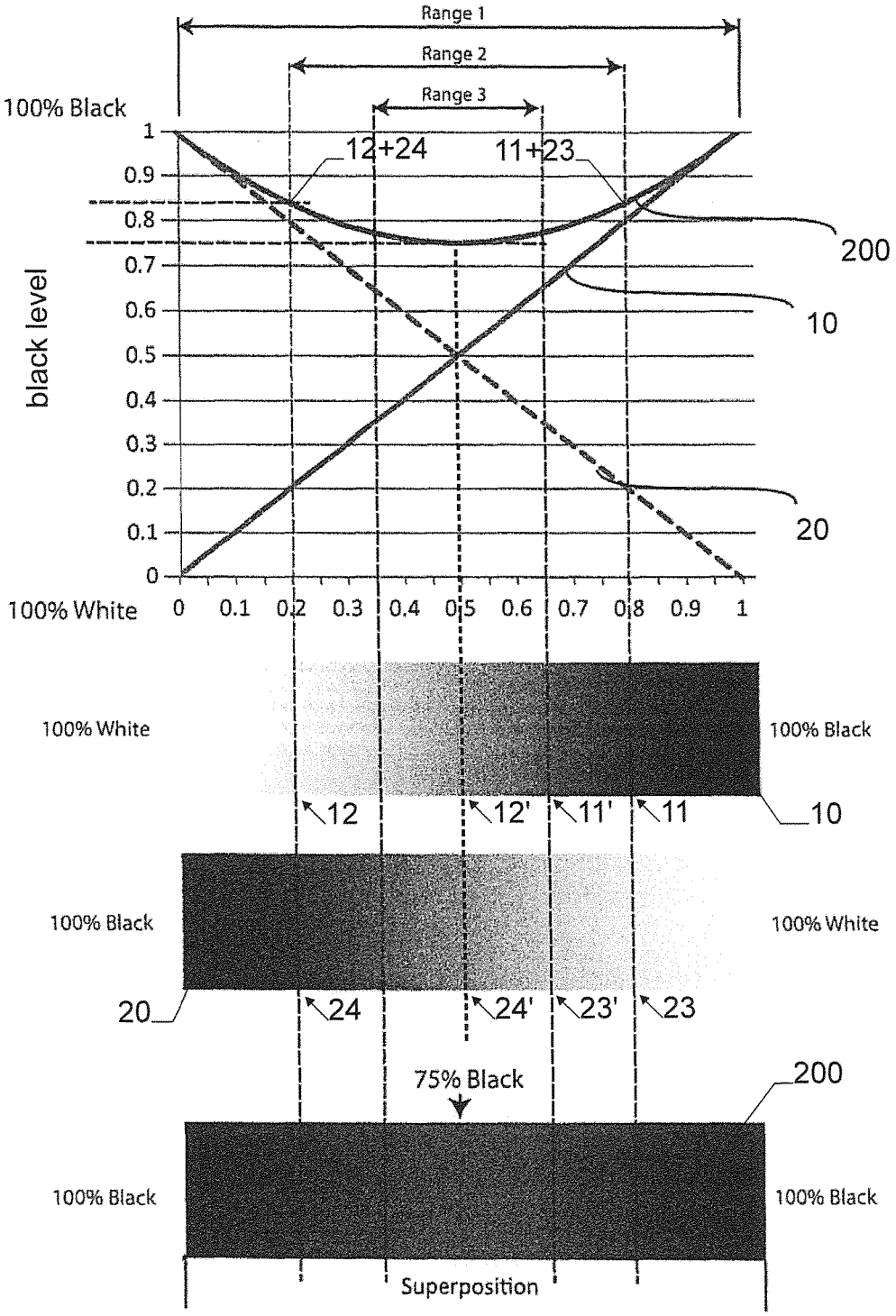
FIG. 1 shows a first pattern 10 and a second pattern 20 for use in a security device 1 as well as a combination of this first pattern 10 with this second pattern 20 in a transmission viewing mode.

FIG. 1 shows a first pattern 10 and a second pattern 20 for use in a security device 1 (the security device 1 is not shown here). in this figure, the first pattern 10 is a grayscale image with a gradient from 100% white (i.e., 0% black) to 100% black. The second pattern 20 is an inverted pattern with record to the first pattern 10, i.e., it is a grayscale image with a gradient from 100% black to 0% black.

When the first pattern 10 is overlaid with the second pattern 20 (i.e., when a first region 11 fully coincides with a third region 23 and a second region 12 fully coincides with fourth region 24) and viewed in a transmission viewing mode, a grayscale image 200 as depicted in the lower part of FIG. 1 is observed. Specifically, a grayscale image going from 100% black to 75% black back to 100% black is yielded.

The upper part of FIG. 1 shows the black levels of the single patterns 10 and 20 as well as of the combined grayscale image 200 (in transmission viewing mode) as functions of position.

What can be seen from the diagram is that in the transmission viewing mode (i.e., with transmissions through the first and through the second pattern being combined), the first region 11 is indiscernible from the second region 12 of the first pattern 10, because both the first region 11 and the second region 12 show the same gray levels of 84% black (see the points labeled 12+24 and 11+23 of the curve labeled 200 in the diagram). Similarly, a third region 23 is indiscernible from a fourth region 24 of the second pattern 20, because both the third region 23 and the fourth region 24 show the same gray levels of 84% black (see the above-referenced points).

This is, because the first region 11 of the first pattern 10 fully coincides with the third region 23 of the second pattern 20 (see vertical line). Similarly, the second region 12 of the first pattern 10 fully coincides with the fourth region 24 of the second pattern (see vertical line). Furthermore, the first pattern 10 (i.e., all regions) is inverted with respect to the second pattern 20.

One possible theoretical approach to explain this is the so-called Demichel equation. For 2 colors, the Demichel equation shows that for the superposition of a layer of color C1 with a density d1 and of a layer of color C2 with a density d2 (both layers having a random halftoning), a surface coverage of white $w=(1-d1)\times(1-d2)$, a perceived color $C1=d1\times(1-d2)$, and a perceived color $C2=d2\times(1-d1)$.

If both colors C1 and C2 are black and if $d2=1-d1$ (inverted patterns), the density of black b (i.e., $b=1-w$) for the superposed image equals to $b=1-d+d12$. This corresponds to the curve labelled 200 in the diagram of FIG. 1.

As an example, the first region 11 of the first pattern 10 and the fourth region 24 of the second pattern 20 both are 80% black. The second region 12 of the first pattern 10 and the third region 23 of the second pattern 20 both are 20% black. Hence, the first region 11 has a different transmittance and reflectivity than the second region 12 and the third region 23 has a different transmittance and reflectivity than the fourth region 24. The superposition of the first region 11 with the third region 23 yields $b=1-0.8+0.8^2$, i.e., b=84% black. This is the same value as for the superposition of the second region 12 with the fourth region 24, namely $b=1-0.2+0.2^2=84\%$ black. Note that a 100% transmittance of the substrate is assumed here (substrate not shown!).

Thus, in a transmission viewing mode (i.e., in a superposition of the first pattern 10 with the second pattern 20), the first region 11 is indiscernible from the second region 12 and the third region 23 is indiscernible from the fourth region 24.

As can be further seen from the Demichel equation:

With the full range of grayscales (see range 1), the perceived black level in transmission viewing mode of the superposed inversed images ranges between b=100% and 75%.

With a smaller range of grayscales (see range 2) such as 0.2 to 0.8 (i.e., the example above), the perceived black level of the superposed inversed images ranges between b=84% and 75% (horizontal dashed lines).

With an even smaller range of grayscales (see range 3) such as 0.35 to 0.65, the perceived black level of the superposed inversed images ranges between b=77.25% and 75%. This is a range of black levels b where the black levels are not distinguishable or indiscernible by the naked eye of a viewer without visual aids. Thus, in this example, in a transmission viewing mode through first pattern 10 and second pattern 20, a first region 11' would be indiscernible from a second region 12' and a third region 23' would be indiscernible from a fourth region 24'. In general, it can be stated that regions with transmitted light intensity-differences below 5% cannot be discerned.

If the first pattern 10 is viewed in a reflection viewing mode (e.g., with an overall reflected light intensity from the first pattern 11 outshining an overall transmitted light intensity at least by a factor of 5), the full superposition of the first pattern 10 with the second pattern 20 does not take place any more and the first region 11 is thus discernible from the second region 12 due to their different reflectivities. In general, it can be stated that regions with reflected light intensity-differences above 5% can be discerned.

Thus, very specific patterns can be created under different viewing conditions and security in enhanced.

Figure 2:
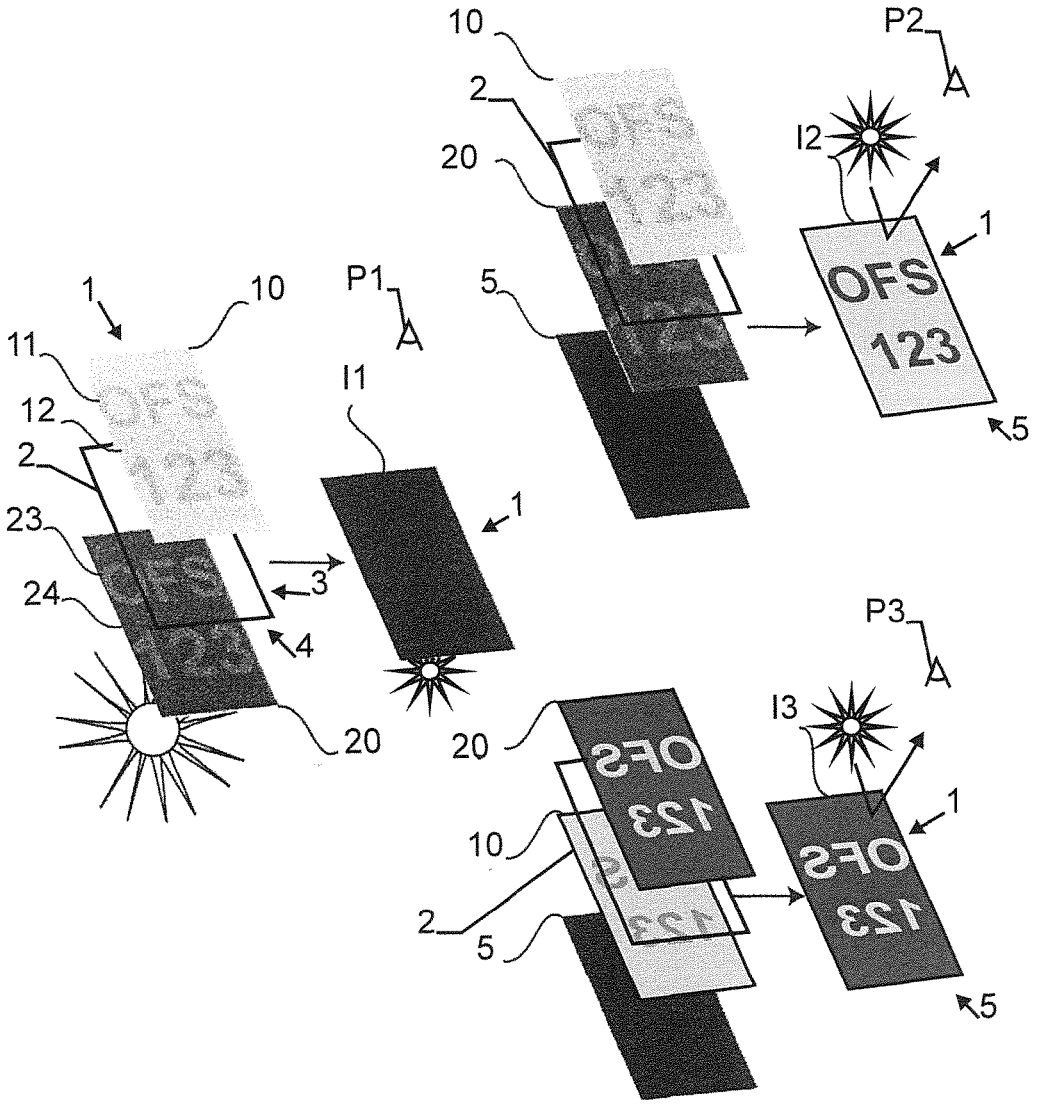
FIG. 2 shows a security device 1 according to a first embodiment of the invention, the security device 1 comprising a transparent substrate 2 and a first pattern 10 and a second pattern 20 arranged on opposite surfaces 3, 4 of said substrate 2.

FIG. 2 shows a security device 1 with a transparent flat flexible multilayer polymer substrate 2 with a thickness of 110 μm. A first pattern 10 (a grayscale image) is applied, in particular printed, onto a first surface 3 of the substrate 2 and a second pattern 20 (a grayscale image) is applied, in particular printed, onto a second opposite surface 4 of the substrate 2. The first pattern 10 comprises a first region 11 ("OFS" and "123" in 80% black) and a second region 12 (background in 20% black) which does not overlap but is adjacent the first region 11. The second pattern 20 comprises a third region 23 ("OFS" and "123" in 20% black) and a fourth region 24 (background in 80% black) which does not overlap but is adjacent to the third region 23. The first region 11 fully coincides with the third region 23 and the second region 12 fully coincides with the fourth region 24. This is e.g. achieved by a high registration printing process of the first and second patterns 10, 20 onto the first and second surfaces 3,4 of the polymer substrate 2.

As shown for the first image I1 taken from a first viewing position P1 in a transmission viewing mode, the first region 11 is indiscernible from the second region 12, because the whole image appears at a uniform gray level of 84% black. As discussed above with regard to FIG. 1, other combinations of black levels would be possible as well as long as the first/second regions 11,12 and the third/fourth regions 23,24 remain indiscernible in the transmission viewing mode.

However, in a reflection viewing mode, which is here facilitated by overlaying the security device 1 with a light absorber 5, the first region 11 is discernible from the second region 12. As shown in a second image 12 taken from a second viewing position P2 (with the first pattern 10 being oriented towards said second viewing position P2) in a reflection viewing mode, the first region 11 appears in a darker color than the surrounding second region 12.

A third image 13 taken from a third viewing position P3 (with the second pattern 20 being oriented towards said third viewing position P3) in a reflection viewing mode shows the third region 23 in a lighter color than the surrounding fourth region 24. Thus, the third region 23 is discernible from the fourth region 24.

Figure 3:
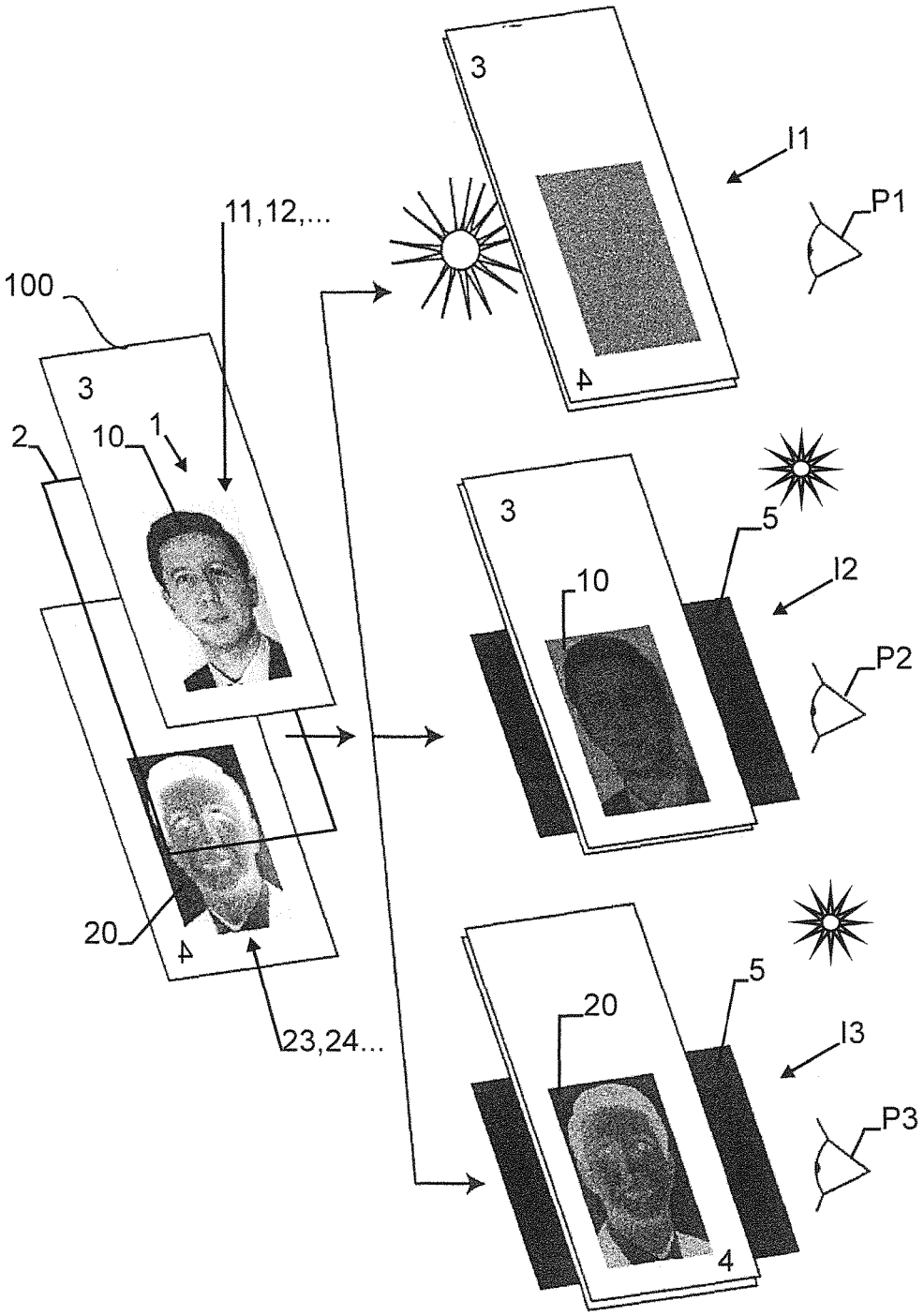
FIG. 3 shows a security document 100 comprising a security device 1 according to a second embodiment of the invention.

FIG. 3 shows a security document 100 comprising a security device 1 according to a second embodiment of the invention. The security device 1 is very similar to the first embodiment shown in FIG. 2 with the exception that the first pattern 10 and the second pattern 20 are inverted grayscale images each comprising a plurality of pixels and not only two distinct regions. Thus, the first and second regions 11, 12 . . . (and likewise the third and fourth regions 23,24, . . . ) are in general defined by a single pixel each and not any more by geometrical letters/numbers.

Other than that, as it is schematically shown on the right hand side of FIG. 3, the security device 1 according to the second embodiment behaves very much like the first embodiment discussed above, i.e., the different regions/pixels in one pattern/image are indiscernible in a transmission viewing mode (first image I1 from a first viewing position P1), while they are discernible in a reflection viewing mode (second image I2 from a second viewing position P2 with the first pattern 10 being oriented towards the second viewing position and third image I3 from a third viewing position P3 with the second pattern 20 being oriented towards the third viewing position P3).

Note that in this embodiment, as in the first embodiment shown in FIG. 2, the first pattern 10 is inverted with respect to the second pattern 20. Here, additionally, care should be taken that grayscale values of the first and second patterns 10, 20 (x-values in a histogram, see ranges in FIG. 1 at the top!) only cover a range of black levels that lead to indiscernible resulting black level differences in transmission viewing mode (see resulting black level differences on the y-axis of the diagram of FIG. 1). In other words, as an example, here, only gray levels between 35% black and 65% black are covered by the patterns 10,20, thus leading to superposed black levels (in the first image I1) between 77.25% and 75% (see above). As discussed above, this is not discernible by a viewer's naked eye.

Figure 4:
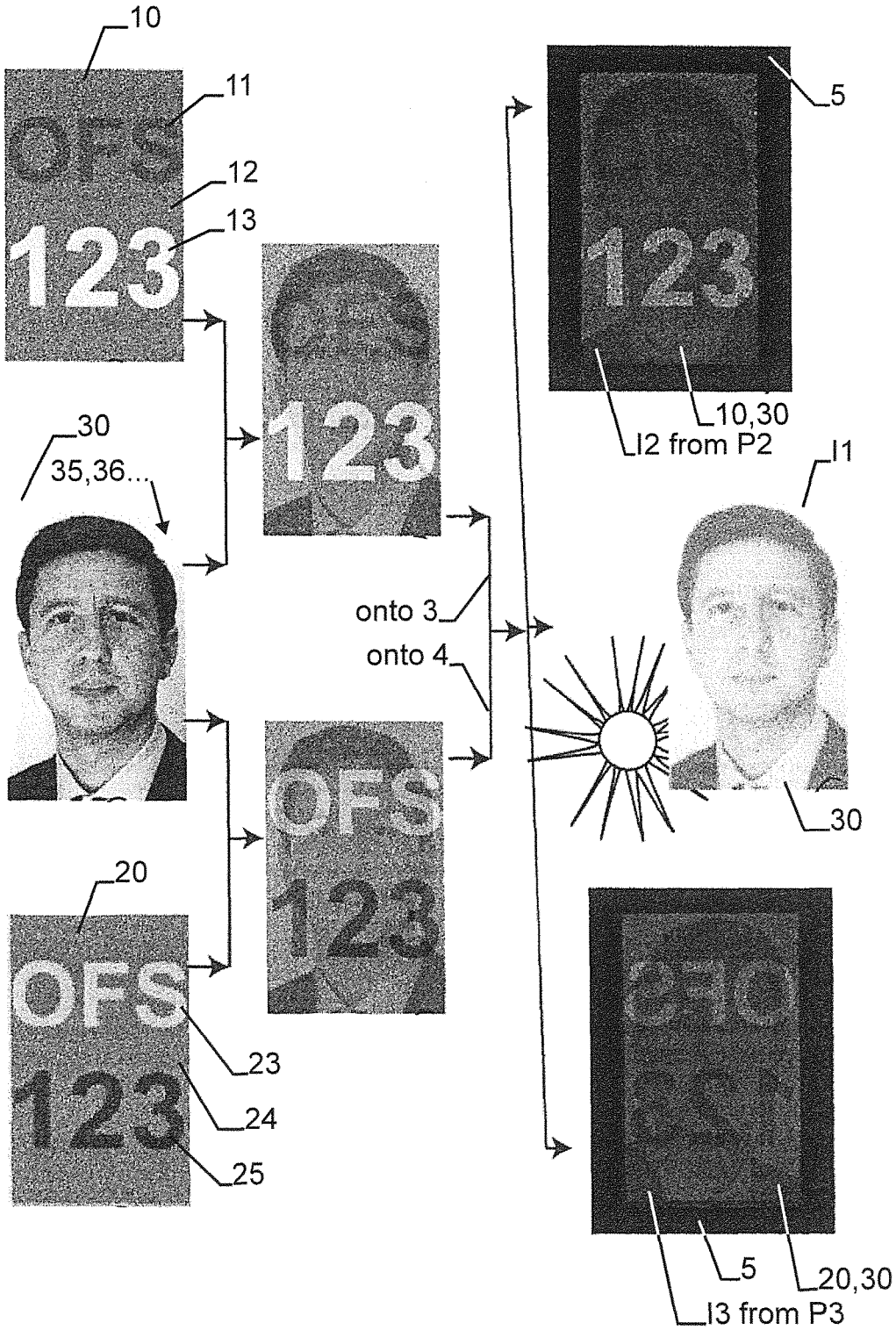
FIG. 4 shows a security device 1 according to a third embodiment of the invention, the security device 1 comprising a first pattern 10, a second inverted pattern 20, and a third pattern 30, FIG. 5 schematically shows a security document 100 comprising the security device 1 of FIG. 2, a light absorber 5, and a folding line 500, FIG. 6 schematically shows the security device 1 of FIG. 2 in a transmission viewing mode, FIG. 7 schematically shows the security device 1 of FIG. 2 in a reflection viewing mode with specular reflection, and FIG. 8 schematically shows the security device 1 of FIG. 2 in a reflection viewing mode with specular reflection and second pattern attenuation by a light absorber 5.

FIG. 4 schematically shows a security device 1 according to a third embodiment of the invention. The security device 1 is very similar to the first embodiment shown in FIG. 2 and to the second embodiment shown in FIG. 3 with the exception that the security device 1 additionally to the first pattern 10 (dark "OFS"=first region 11, medium background=second region 12, light "123"=additional region of the first pattern 10) on the first surface 3 of the substrate 2 (which is not shown here for clarity) and to the second pattern 20 (inverted with respect to the first pattern 10, i.e., light "OFS"=third region 23, medium background=fourth region 24, dark "123"=additional region of the second pattern 20) on the second surface 4 of the substrate 2 comprises a third pattern 30 that is mixed into the first pattern 10 and into the second pattern 20 before the actual application of the patterns. Another option which is not shown here would be to apply, in particular print, the third pattern 30 between single layers of the multi-layered substrate. The third pattern 30 comprises a fifth region 35, a sixth non-overlapping region 36, . . . which are single pixels each.

Then, as it is shown in the first image I1, in a transmission viewing mode, only the third pattern 30 is visible because the first pattern 10 and the second pattern 20 cancel each other out as discussed above with regard to the first two embodiments of the invention.

However, in a reflection viewing mode as shown in second image I2 (first pattern 10 is oriented towards the second viewing position P2), both the first pattern 10 and the third pattern 30 are visible (i.e., the first region 11 is discernible from the second region 12 and, respectively, the fifth region 35 is discernible from the sixth region 36).

In a reflection viewing mode as shown in third image I3 (second pattern 20 is oriented towards the third viewing position P3), both the second pattern 20 and the third pattern 30 are visible (i.e., the third region 23 is discernible from the fourth region 24 and, respectively, the fifth region 35 is discernible from the sixth region 36).

Figure 5:
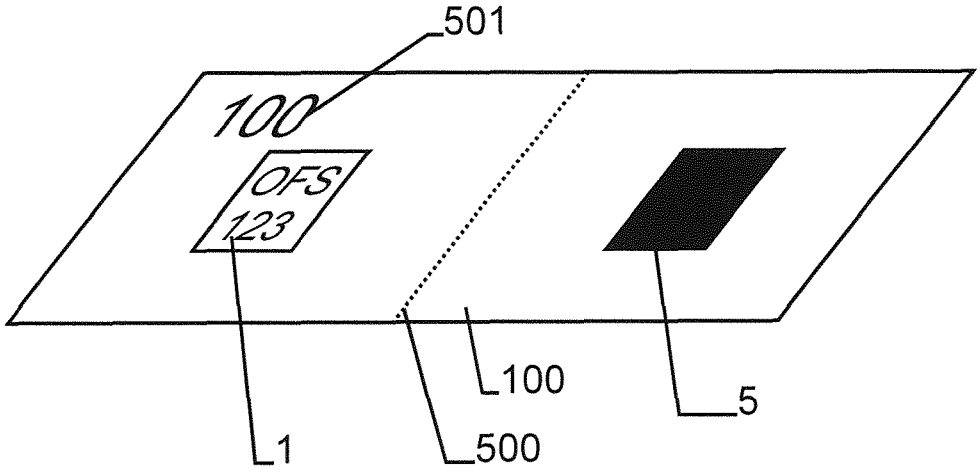

FIG. 5 schematically shows a security document 100 (a banknote with a denomination 501) comprising the security device 1 of FIG. 2. The security device 1 is arranged in a window of the security document 100 and a light absorber 5 consisting of a region with 100% black is arranged at a distance to the security device 1. If the security document 100 is folded along a folding line 500, the light absorber 5 can be brought into overlap with the security device 1 and thus a reflection viewing mode is easier to achieve (see below).

Figure 6:
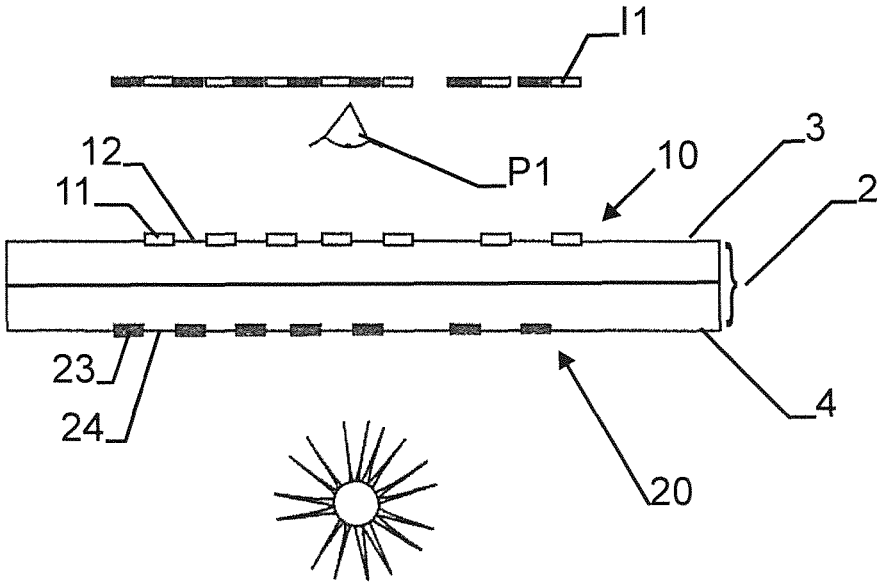

FIG. 6 schematically shows the security device 1 of FIG. 2 in a transmission viewing mode. The security device 1 comprises the transparent substrate 2 with the first surface 3 and the second surface 4. The first pattern 10 with the first region 11 and the second region 12 is arranged on the first surface 3 (only schematically shown). The second pattern 20 with the third region 23 and the fourth region 24 is arranged on the second surface 4 (only schematically shown). In a transmission viewing mode (image I1 at a viewer's first viewing position P1), for at least one transmitted wavelength through said security device, said first region is indiscernible from said second region and said third region is indiscernible from said fourth region (only schematically shown).

Figure 7:
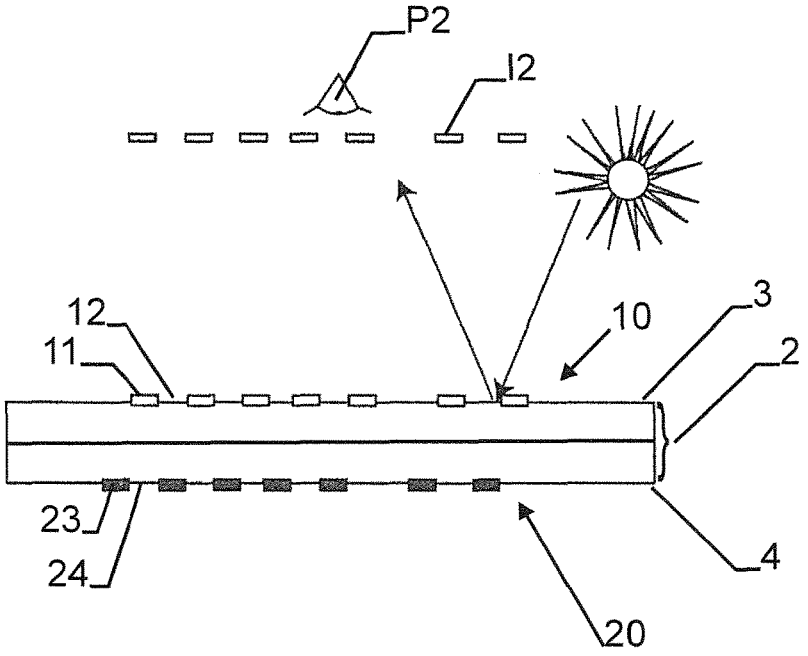

FIG. 7 schematically shows the security device 1 of FIG. 2 in a reflection viewing mode with specular reflection. In a reflection viewing mode (image I2 at a viewer's second viewing position P2), for at least one (specularly by the first surface 3) reflected wavelength from said security device, said first region is discernible from said second region (only schematically shown).

Figure 8:
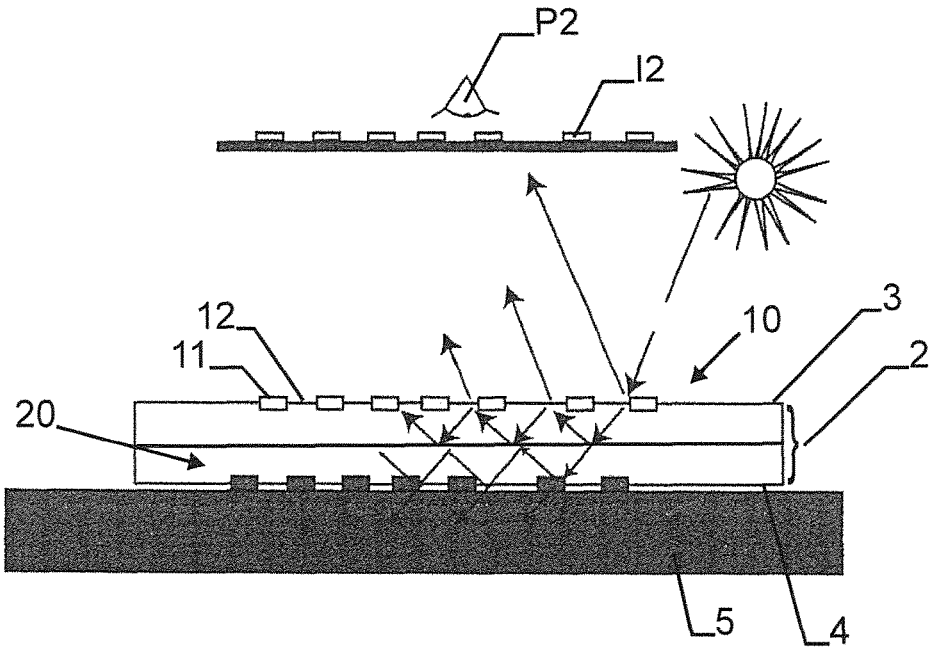

FIG. 8 schematically shows the security device 1 of FIG. 2 in a reflection viewing mode with specular reflection and second pattern attenuation which is facilitated by a light absorber 5. The situation is essentially the same as in FIG. 7, but in addition to only specular reflection on the first surface 3, a light absorber 5 is arranged at the second surface 4 and helps to attenuate the second pattern 20. This is due to the propagation of light and the multiple reflections of the light inside the substrate 2.

Figure 9:
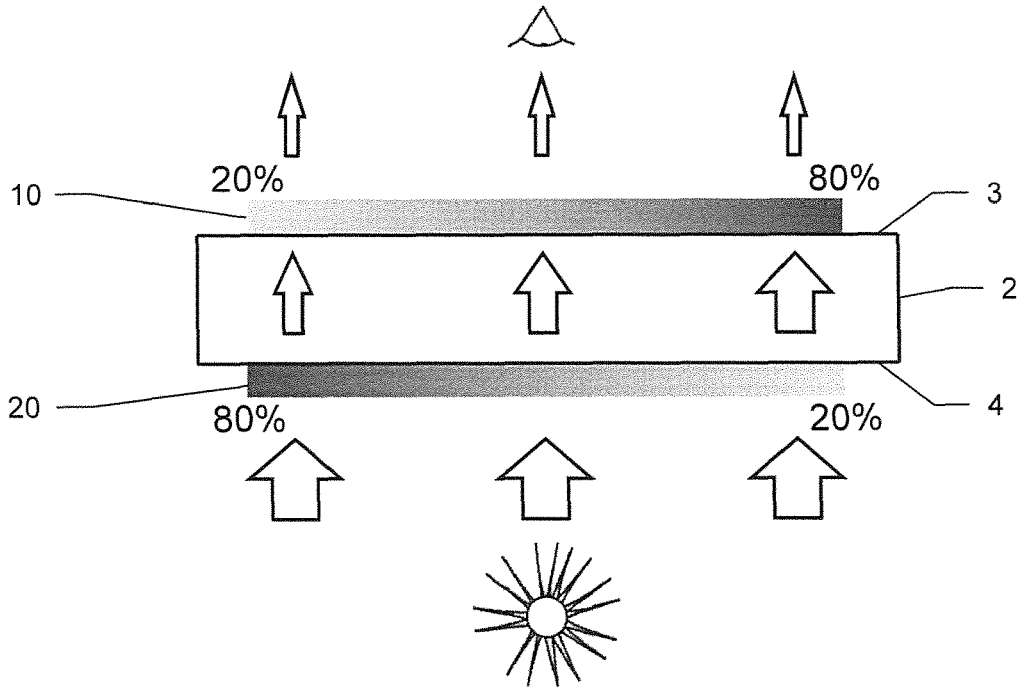
FIG. 9 schematically shows another security device in the transmission viewing mode with an illustration of the light intensity in different steps.

Yet another embodiment is shown in FIG. 9. It shows a security device in the transmission viewing mode. The first pattern 10 is printed on the first surface 3 and the second pattern 20 is printed on the second surface 4. The first and second patterns e.g. comprise black levels in a range between 20% and 80% according to the color gradients shown in FIG. 9. The black levels on the first pattern are inverted with respect to the black levels on the second pattern. The thicknesses of the arrows show the light intensity in different steps on the way the light goes through the security device. The light, originating from a light source, goes uniformly through the second surface 4 and enters the substrate 2. Light is absorbed by the second pattern 20 in dependence of the black levels of the second pattern. Consequently the light intensity going through the substrate 2, which is shown by the thickness of the arrows in the substrate 2, is the smaller the higher the black level is on the second pattern 20. Since the black level on the first pattern 10 is inverted with respect to the second pattern 20, the light intensity is homogenized after having left the substrate 2 and having passed the first surface 3.

Figure 10:
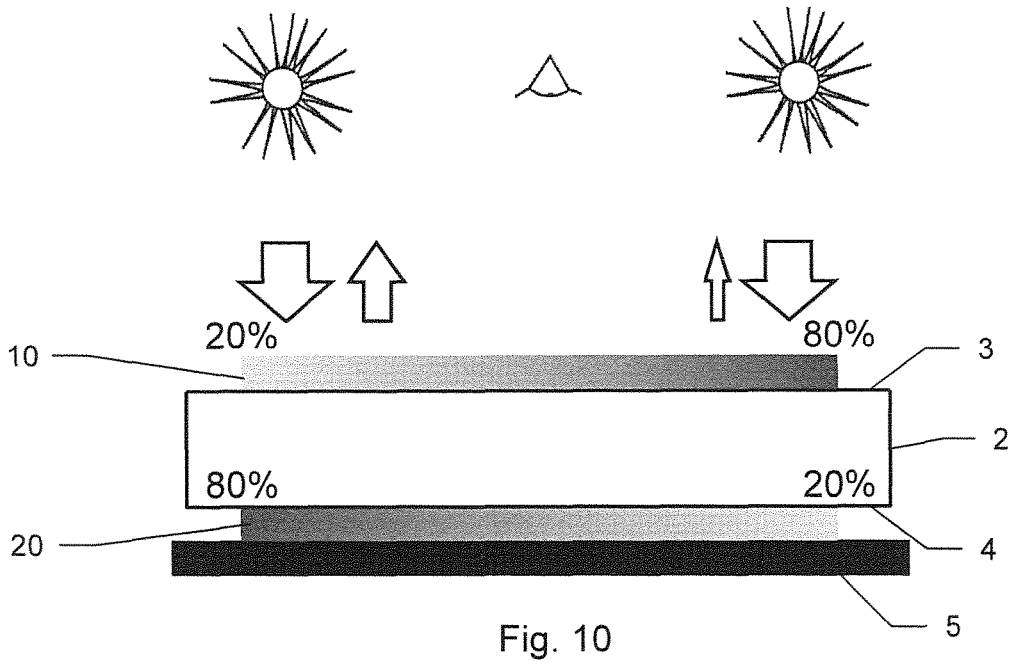
FIG. 10 schematically shows another security device in the reflection viewing mode with an illustration of the light intensity in different steps.

FIG. 10 shows the same security device as in FIG. 9, but in the reflection viewing mode. The substrate can reflect the light specularly or diffusely. The arrows show that the lower the black level on the first surface 3 is, the more light is reflected, because the black ink absorbs the light and does not reflect it. The effect of the second surface 4 is attenuated by the light absorber 5.

Remark:

While there are shown and described presently preferred embodiments of the invention, it is to be distinctly understood that the invention is not limited thereto but may be otherwise variously embodied and practiced within the scope of the following claims.

The invention claimed is:

1. A security device for verifying an authenticity of a security document, in particular of a banknote, a passport, a document of value, a certificate, or a credit card, the security device comprising:

an at least partially transparent substrate and with a first surface and a second surface, a first pattern arranged on the first surface of the substrate, a second pattern arranged on the second surface of the substrate, wherein the first pattern on the first surface is arranged fully in register with the second pattern on the second surface, wherein the first pattern and the second pattern each comprise a plurality of pixels with at least three different gray levels visible from a macroscopic perspective, wherein the first pattern and the second pattern cover only gray levels in a range between 20% black and 80% black, wherein the first pattern is inverted with respect to the second pattern, such that a gray level of x % in said first pattern is inverted to a gray level of (100%-x %) in said second pattern.

2. The security device of claim 1, wherein the first pattern and the second pattern are applied by absorbing inks.

3. The security device of claim 1 wherein said substrate comprises multiple layers.

4. The security device of claim 1, wherein the gray levels of the first pattern and of the second pattern are indiscernible at least when an overall transmitted light intensity through said security device outshines an overall reflected light intensity from said security device at least by a factor of 5.

5. The security device of claim 1 further comprising a third pattern arranged on or in said substrate, wherein said third pattern comprises a plurality of pixels visible from a macroscopic perspective, wherein different gray levels of said third pattern are discernible in said a transmission viewing mode and in a reflection viewing mode.

6. The security device of claim 5, wherein said third pattern comprises a plurality of pixels with at least three different gray levels visible from a macroscopic perspective.

7. The security device of claim 1 wherein a transmittance of said substrate is higher than 50%, at least for at least one transmitted wavelength through said security device.

8. A security document, in particular a banknote, a passport, a document of value, a certificate, or a credit card, wherein the security document comprises a security device of claim 1, in particular arranged in a window of said security document.

9. The device of claim 1 wherein said substrate is partially reflecting.

10. The device of claim 1 wherein the first pattern and the second pattern cover only gray levels in a range between 35% black and 65% black.

11. The device of claim 1 wherein said substrate is specularly reflecting.

12. A method for generating a security device for verifying an authenticity of a security document, in particular of a banknote, a passport, a document of value, a certificate, or a credit card, the method comprising steps of providing an at least partially transparent substrate and with a first surface and a second surface, providing a first source image with at least three different gray levels, modifying a contrast of said first source image to generate a first modified image, wherein the first modified image covers only gray levels in a range between 20% black and 80% black, inverting the first modified image for yielding a second modified image, such that a gray level of x % in said first pattern is inverted to a level of (100%-x %) in said second pattern, generating a first pattern from said first modified image, generating a second pattern from said second modified image, applying the first pattern on said first surface of said substrate, applying the second pattern on said second surface of said substrate, wherein the first pattern on the first surface is arranged fully in register with the second pattern on the second surface.

13. The method of claim 12, wherein for generating the first pattern and/or second pattern, a third pattern is mixed with the first modified image to generate the first pattern and/or wherein a third source image is mixed with the second modified image to generate the second pattern such that in a transmission viewing mode only the third pattern is visible while the first pattern and the second pattern cancel each other out.

14. The method of claim 12 wherein the first pattern and the second pattern are printed by absorbing inks.

15. The method of claim 12 comprising the steps of printing the first pattern on said first surface and printing the second pattern on said second surface.

* * * * *